US006845794B2

(12) United States Patent
Johnson

(10) Patent No.: US 6,845,794 B2
(45) Date of Patent: Jan. 25, 2005

(54) PAINTBALL FILLING SYSTEM

(76) Inventor: Lance G. Johnson, 12545 White Dr., Fairfax, VA (US) 22030

( * ) Notice: Subject to any disclaimer, the term of this patent is extended or adjusted under 35 U.S.C. 154(b) by 0 days.

(21) Appl. No.: 10/704,134

(22) Filed: Nov. 10, 2003

(65) Prior Publication Data

US 2004/0140014 A1 Jul. 22, 2004

Related U.S. Application Data

(63) Continuation of application No. 10/081,105, filed on Feb. 25, 2002, now Pat. No. 6,644,366.

(51) Int. Cl.[7] ..... B65B 1/04

(52) U.S. Cl. ..... 141/331; 141/340; 141/247; 124/72; 124/74

(58) Field of Search ..... 141/331–345, 141/234, 235, 247; 124/70–76

(56) References Cited

U.S. PATENT DOCUMENTS 6,644,366 B2 * 11/2003 Johnson ..... 141/331

* cited by examiner

*Primary Examiner*—Steven O. Douglas
(74) *Attorney, Agent, or Firm*—Roylance, Abrams, Berdo & Goodman L.L.P.

(57) ABSTRACT

Disclosed is a filling system for loading one or more paintball reservoir tubes with paintballs. The system is made of a paintball fill funnel and a support for at least one, and preferably a plurality of reservoir tubes. The fill funnel is dimensioned to fit within the reservoir tube and rest on the rim of the reservoir tube. A support shoulder, rim, or plurality of support shoulders on the outside of the fill funnel form a stable plane atop the tube rim. Each funnel can have more than one spout that communicates with a central funnel chamber for filling a plurality of paintball reservoir tubes simultaneously. The tube support can take a variety of configurations.

4 Claims, 5 Drawing Sheets

PAINTBALL FILLING SYSTEM

This application is a continuation of application Ser. No. 10/081,105, filed Feb. 25, 2002, now U.S. Pat. No. 6,644,366 the disclosure of which is herein incorporated by reference.

FIELD OF THE INVENTION

The invention relates to a kit and kit components that are useful for filling paintball rounds into paintball reservoir tubes or supply hoppers.

BACKGROUND

Paintball is a sport played among participants by propelling at each other a plurality of water soluble paint-filled gelatin capsules through a gas-powered marker. Games are often played with two teams previously or spontaneously "organized" to compete on a designated field of terrain, structure, and/or scenario.

There are a wide variety of marker designs, clothing, and eye protection goggles. Skill and interest levels vary widely as do current prices for 0.68 caliber (typically 0.682–0.692 inches in diameter) paintball rounds. Paintballs are available in 2000–2400 round cases for $40–$75 (US) or $0.02–$0.04 per paintball round. Most cases are made of four 500 or 600 round plastic bags.

Paintball rounds are not very accurate. Due to their spherical shape and liquid-filled center, the paintball does not react to traditional methods of trajectory stabilization. Reasonable accuracy is achievable to distances of about 10–15 m (30–50 ft). Beyond that, spin on the paintball can cause erratic behavior unless the diameter of the paintball is well matched to the internal diameter of the barrel. This, and a widespread misunderstanding of the drop rate due to gravity, explain why most paintball games are characterized by a "hit" rate of about 3–5%. Nonetheless, the exhilaration and adrenaline of the game mean that many paintball rounds will be fired from carried reservoir tubes.

The most common, commercially available supply hoppers that feed the marker will hold 200–300 rounds. This hopper is often refilled many times during a 15 minute match. Thus, additional reservoir tubes are typically worn in a waist harness and hold 100, 140, or 200 paintballs. Many players carry 2–10 additional reservoir tubes.

There is no good method for filling reservoir tubes quickly. Many players load paintballs into the tubes one handful at a time. Others cut a hole in one end of the bag and try to pour the paintballs while juggling the filling tube and emptying bag. An assistant is often used. These processes are relatively slow and are subject to slips that spill the entire tube or bag. It is well accepted that paintball rounds cannot, or at least should not, be used after a spill onto unpaved ground due to the adverse effects of particulate contamination on the fairly close tolerances of internal moving parts in the marker. Spilled paintball rounds represent a significant loss of time, resources, and investment.

For tournament players, speed to refill can an essential element between successive rounds. The team who can refill the fastest has a marked advantage in the subsequent game.

It would be advantageous to have a process and system that would help an individual to fill one or more paintball reservoir tubes rapidly, with high stability, and without the assistance of others.

It would also be helpful to have a filling process and system that would reduce the time needed to fill a reservoir tube or supply hopper with paintball rounds. It would be especially useful to have a process and fill system that would allow a player or team mate to refill one or more tubes in the 3–5 minutes.

SUMMARY OF THE INVENTION

It is an objective of the invention to provide a filling process and fill system components that are useful alone or in combination to help fill one or more paintball reservoir tubes or a supply hopper quickly and with reduced chances for inadvertent spills.

It is also an objective of the invention to provide a process for filling one or more paintball reservoir tubes with fill system components that will allow a reservoir tube to be filled faster than sequential handfuls of paintball rounds.

A further objective of the invention is to provide a process and fill system that allows the simultaneous filling of two or more paintball reservoir tubes.

In accordance with these and other objectives of the invention that will become apparent from the description herein, a reservoir tube filling process according to the invention comprises: filling a vertically standing, cylindrical paintball reservoir tube with a plurality of paintballs by directing said paintballs into said reservoir tube with a paintball fill funnel that is supported on an upper edge of said reservoir tube in a substantially horizontal plane, wherein said fill funnel exhibits (a) an open, unobstructed top opening having a peripheral top rim, (b) an interior bowl chamber having lateral guiding surfaces that direct paintballs downwardly without obstruction and inwardly to (c) at least one unobstructed outlet spout that leads said paintballs directly into said reservoir tube, wherein said fill funnel is supported on an upper edge of said reservoir tube in a substantially horizontal plane by at least one horizontally extending support shoulder formed into an outer surface of said fill funnel.

A gravity-based paintball fill funnel according to the invention has: (a) an open, unobstructed top opening having a peripheral top rim, (b) an interior bowl chamber having lateral guiding surfaces that direct paintballs downwardly without obstruction and inwardly to (c) at least one unobstructed outlet spout that leads said paintballs directly down and out through a bottom discharge opening. Preferably, the outlet spout has vertically extended, nontapering, cylindrical parallel wall inner wall surfaces. Even more preferably, the inner wall surfaces are smooth and featureless. The outer surfaces should also be cylindrical, parallel, and in close fit to the inside surfaces of the paintball reservoir tubes. At least one support shoulder is formed on or secured to the outside of the spout so that the fill funnel rests in a level plane on the top edge of the paintball reservoir tube. The support shoulder or shoulders support the fill funnel in a stable, substantially horizontal plane that is substantially perpendicular to the vertical axis of the reservoir tube and allows the fill funnel to remain within the reservoir tube despite the lateral forces seen by rapid filling of the funnel and reservoir tubes.

Also included in a fill system according to the invention is a paintball reservoir tube support base that will provide stable, vertical support for one or more reservoir tubes. The support base has at least one, and preferably a plurality of openings, each dimensioned to receive a paintball reservoir tube and support it upright with stability during a filling. The support base can exhibit a number of configurations.

Used alone or in combination, the filling process and system according to the invention provide shorter fill times with reduced paintball losses from slips and spills.

DETAILED DESCRIPTION

Figure 1:
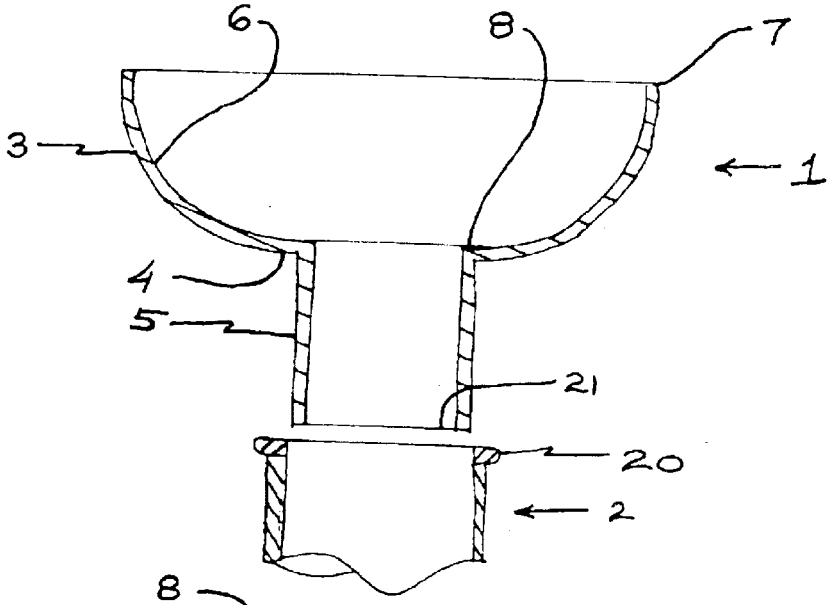
FIG. 1 shows a paintball fill funnel with a single spout fitting inside a paintball reservoir tube.

A paintball fill funnel and a reservoir tube support are used separately or in combination to help players fill one or more paintball reservoir tubes faster and with fewer lost paintballs. Because the filling process is performed by gravity, it is convenient to describe the funnel and tube support in terms of top, bottom, up, and down. Most reservoir tubes used in paintball are also round, so it is convenient to describe the tubes and the associated spout portion of the funnel in terms of inside and outside diameter with the understanding that virtually any geometric cross sectional shape can be used to guide paintballs from the fill funnel spout or spouts into the reservoir tube or tubes.

The paintball fill funnel is preferably an integrally formed, one piece device that has a top rim, a central bowl chamber with lateral walls and a bottom floor that guides paintballs downwardly, and at least one discharge spout below the central bowl chamber. It is, however, within the invention to provide a central bowl chamber having at least one mating connection (such as a threaded connection or a "twist-and-lock" connection) with at least one spout. The use of interchangeable spouts can allow flexibility for reservoir tubes of different internal diameters or top lip configurations.

The funnel can take a wide variety of self-supporting central bowl chamber shapes, wall heights, and inside dimensions. Exemplary shapes for the central bowl chamber are generally hemispherical, cylindrical, cubical, and the like. The central bowl chamber can have one or more smoothly curving sidewalls or combinations of shapes that are effective for guiding paintballs introduced into the central bowl chamber to one or more spouts from the bottom of the central bowl chamber. Preferably, the central bowl chamber has an decreasing cross sectional area over at least some distance from top to bottom toward at least one spout and the lateral wall surfaces can be symmetric or asymmetric.

The central bowl chamber volume desirably holds a sufficient number of spherical paintballs with a diameter of about 0.63–0.70 inches (about 1.6–1.8 cm) to act as a reservoir for smooth filling of a paintball reservoir tube communicating with the spout or spouts leading from the bottom of the central bowl chamber. The inside diameter of the open top rim is desirably within the range of 5–25 cm, preferably 7–20 cm, and most preferably within the range of 7–15 cm. It is preferred that the bowl of the funnel exhibit a sufficient volume to hold about 20–600 paintballs.

The central bowl chamber can also include removable partitions that isolate one or more outlet spouts. Such removable partitions would permit, for example, a four spout paintball funnel to be used for filling only one, two, or three paintball reservoir tubes by isolating one or two outlet spouts. Removable partitions are preferably inserted into channels running vertically down the inside of the central bowl chamber lateral walls or down a slotted ridge formed into or onto opposing interior walls of the central bowl chamber.

Each bottom spout guides paintballs from the central bowl chamber into a paintball reservoir tube. For round reservoir tubes, each spout is preferably nontapering, circular in horizontal cross section, and externally dimensioned to fit within the paintball reservoir tube. The outside diameter of the spout is preferably made of nontapering, straight walls (i.e., cylindrical) that are slightly smaller than the inside diameter of the cylindrical paintball reservoir tube to form a close fit that will remain upright when seated into a reservoir tube but readily removable therefrom without removing or dislodging any lip or cover attached to the rim of the reservoir tube. A suitable outside diameter for the funnel spout is generally within the range of 5–6.5 cm, preferably within the range of 5–5.4 cm for a reasonable fit in the paintball reservoir tubes commercially available.

The inside diameter of the spout will depend primarily on the structural strength and toughness of the material used to make the funnel. The inside diameter of the spout preferably exhibits, however, an unrestricted, open flow path that does not hinder the flow of paintballs down through the central bowl chamber and spout into the reservoir tube.

The fill funnels of the invention should be made of a durable material that can withstand fairly rough handling. Polymeric materials formed by casting, molding, or similar processes are preferred for low cost, high durability, and weather resistance. It is, however, feasible to use various metals, composites, structural paper products and similar materials for the fill funnels of the invention.

The stability of the paintball fill funnel atop reservoir tube is enhanced by the use of one or more shoulder supports located around the outside of the spout, preferably at about the bottom of the bowl. The shoulder support can be in the form of a single shoulder or "lip" around the entire outside perimeter of the spout or at least three discrete shoulder supports distributed uniformly around the spout perimeter and extending outwardly therefrom for the distance noted above. The shoulder support should provide a level support platform of sufficient depth to rest on and be stabilized on the top of the paintball reservoir tube opening. The shoulder support depth is preferably within the range of about 2–10 mm, preferably 3–7 mm, although thinner or deeper shoulder depths can be used based on the allowable tolerances within the reservoir tube.

Also preferable is a shoulder support design that forms a support plane that is parallel to the plane formed by the top rim of the funnel. Parallel planes allow for maximum transfer to the central bowl chamber and into the reservoir tubes with minimized chances for tipping of the funnel or loss of paintballs.

The stability of the funnel can also be enhanced if the length of the spout extends for a distance into the reservoir tube. Lateral tipping is reduced or prevented by contact between the outer wall of the spout and the inside wall of the reservoir tube. A suitable spout length is at least 0.5 cm from the bottom of the bowl, preferably within the range of 0.5–10 cm, and most preferably within the range of 3–8 cm.

The spout length can also be measured in terms of a ratio of spout length (from the bottom of the shoulder support) to the effective inside spout diameter. Suitable ratios are preferably within the range of about 0.25 about 2. Preferably, the spout length to inside diameter is within 0.5–1.5. Longer spouts can be used for additional stability although the additional length may make the funnel more bulky to store in an already full gear bag.

The fill funnel of the invention can contain more than one outlet spout communicating with a central bowl. The dimensions of each spout will be within the ranges described previously but will gain additional stability from additional, spaced apart spouts within adjacent reservoir tubes. The position of each spout preferably coincides with the positions of adjacent reservoir tubes within a tube support.

For example, a funnel with a central bowl and four spouts can be used with a tube support having four openings for four reservoir tubes to fill all four tubes almost completely and simultaneously from a single bag of 500 paintballs. Such a funnel and support system would be sufficiently small that it would permit a competitor to use the system on the side of the field for a rapid refill of reservoir tubes. A waistband carrier could be refilled in less time than it would take each team to switch sides for the next match.

Tube support bases according to the invention hold at least one paintball reservoir tube in an upright position with sufficient lateral support and/or bottom weight to avoid tipping during a fill operation. Exemplary tube support bases have one or more cylindrical holes in a rigid or semirigid base (e.g., a medium or high density closed or open cell foam having a height of about 2–8 inches (5–20 cm)); circular openings in a supported, planar surface (e.g., multiple openings in a piece of wood or rigid foam supported by elevating legs or perpendicular support walls); or a support platform rotatably secured to a relatively heavy support (such as a gear bag or box of paintball rounds).

The paintball reservoir tube filling process is straightforward and is conveniently described with reference to the simultaneous filling of four paintball reservoir tubes. The four tubes are opened and inserted vertically into a support rack. A four spout fill funnel is then positioned so that each of the four spouts is inserted into one of the reservoir tubes, and the support shoulder or shoulders rests on the upper rim of one or more reservoir tubes. The support shoulders should for a substantially horizontal support plane for the fill funnel that is substantially perpendicular to the vertical axis of each supported reservoir tube.

A quantity of paintballs, preferably an amount that is about the sum of all capacities of each reservoir tube individually, are introduced into the open top of the central open chamber of the fill funnel. The paintballs fall downwardly through the open central bowl chamber and are guided inwardly, directly or indirectly, by the lateral walls of the central bowl chamber toward the spouts. If desired, the bottom of the bowl chamber area can be formed to include vertical mounds or guide surfaces that will direct the paintballs toward an adjacent spout. The paintballs pass through the open and unobstructed top opening of the spout, down the spout, and into the reservoir tube.

If the paintball fill funnel has more than one spout, one or more partition dividers can be used to isolate one or more outlet spouts and allow a multi-spouted funnel to fill a fewer number of reservoir tubes than the maximum number of possible. Direct or indirect contact with the divider partition or partitions will direct paintballs in the central bowl chamber to one or more spouts within the isolated area and to the reservoir tube positioned beneath each spout.

If the support plane is formed by the support shoulders near the bottom of the central bowl chamber (as is preferred), visual inspection will confirm when the reservoir tube is full or overfull. Paintballs from overfull reservoir tubes can be readily scooped, pushed, or otherwise moved to an adjacent reservoir tube that is not yet full by rolling the paintballs across the bottom of the reservoir tube to the appropriate spout on the bottom of the central bowl chamber. Similarly, additional paintballs are readily added to "top off" an unfilled reservoir tube. The spout is then removed, the top caps closed on each reservoir tube, and the filled reservoir tubes are removed from the support rack.

The following figures are provided as an aid to understanding the invention. The same reference number is used in the various figures to identify similar structure.

FIG. 1 shows a paintball funnel 1 useful for filling reservoir tube 2. Funnel 1 has a central bowl chamber 3, external support shoulder 4, and outlet spout 5. Spout 5 preferably has a horizontal cross section shape that corresponds to the shape of the paintball reservoir tube, e.g., nontapering walls with a circular cross section thereby forming a cylindrical shape. Most preferably, paintballs introduced into central bowl chamber 3 should flow without obstruction or hindrance down through central bowl chamber 3 as guided inwardly by the lateral walls of the central bowl chamber to bowl-spout junction 8, down into spout 5, out through bottom discharge opening 21, and into reservoir tube 2.

Bowl chamber 3 can exhibit almost any shape sufficient to hold a quantity of paintballs. One example is a hemisphere (FIG. 1) in which inner walls 6 of bowl chamber 3 exhibit a smooth convex curve from top lip 7 to inner bowl-spout junction 8. Another embodiment is shown in FIG. 2 and has a substantially vertical upper wall portion 9 which changes to an inwardly tapering, angled lower wall portion 10.

Figure 2:
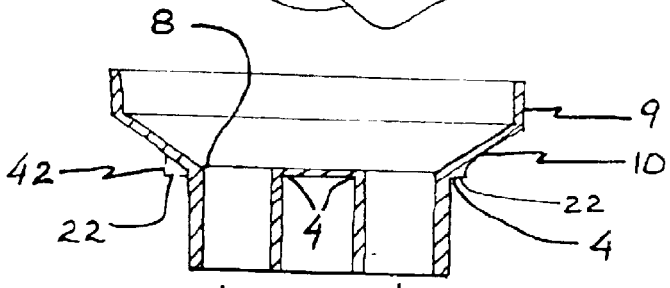
FIGS. 2 and 3 depict a paintball fill funnel with two spouts communicating with a central bowl.
Figure 3:
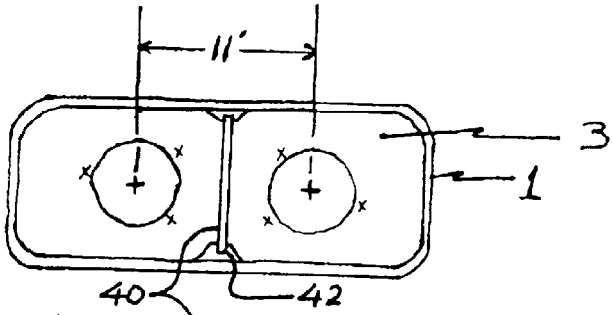
Figure 4:
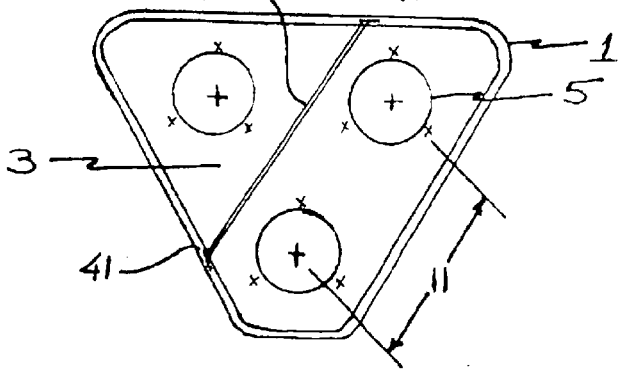
FIG. 4 is a topview illustrating a paintball fill funnel with three spouts communicating with a central bowl.
Figure 5:
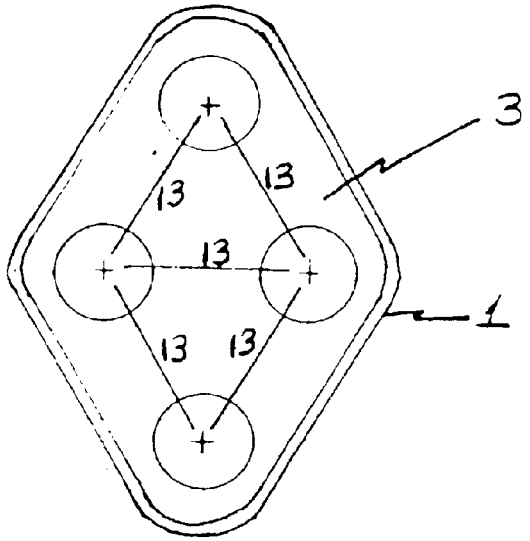
FIGS. 5 and 6 are top views showing layouts for a four spout fill funnel communicating with a central bowl.
Figure 6:
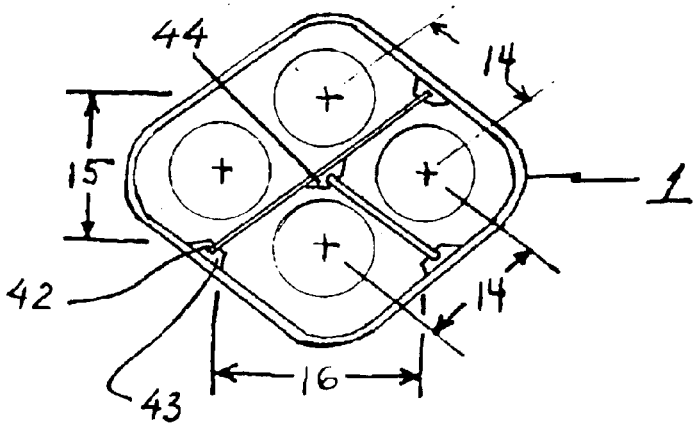

As shown in FIG. 2, support shoulder 4 is formed into the outside of lower wall portion 10 adjacent bowl-spout junction 8. If a continuous shoulder is not desired, a plurality of discrete support shoulders 42 (shown in hatched lines in FIG. 2) can be formed onto or secured to the outside of funnel 1 at a location that is preferably near or effectively near bowl-spout junction 8. Discrete support shoulders 42 should be used in sufficient numbers, e.g., at least three to form a substantially horizontal support plane around the funnel. Support shoulders 4 and 42 should each have a substantially flat, horizontal contact surface 22 that is substantially perpendicular to the outer walls of spout 5 and of sufficient depth to rest in a stable, substantially horizontal plane when resting on rim 20 of reservoir tube 22.

Funnel 1 can be formed so that bowl 3 feeds a plurality of spouts 5 (FIGS. 3–6). Funnels with two (FIG. 3), three (FIG. 4), and four (FIGS. 5 and 6) spouts 5 are shown. More spouts 5 can be formed to feed from bowl 3 up to about six spouts 5 (not shown) where the funnel starts to become uncomfortably large. Funnels with one to four spouts 5 are particularly preferred.

When a funnel is used with multiple spouts 5, centerline distance 11, 12, 13, 14, 15, and 16 between possible locations of spouts 5 should be coordinated with openings 17 in support base 18 to provide the ability to fill multiple reservoir tubes 2 simultaneously from a central bowl chamber 3. Preferred tube distributions are arranged within support base 18 can include two or more spouts (FIG. 3), but preferably include centerline arrangements that form one or more isosceles triangles (two equal sides as in FIG. 6) or equilateral triangles (FIGS. 4, 5, 7, and 9).

Preferred locations for a plurality of discrete shoulder supports 4 are shown with an "x" around the outside of funnel 1. Preferably, such discrete supports are disposed on the outside of funnel 1 on spout 5 at substantially the juncture of spout 5 and central bowl chamber 3.

Paintball fill funnels that have multiple spouts can have removable partitions 40 that fit within slots 41 in inner walls 6 of central bowl chamber 3 or in groove 42 in surface elevation feature 43. Partitions 40 can also have partition slots 44 which are used to isolate one or more spouts 5 for filling a fewer number of paintball reservoir tubes that the maximum number of spouts 5.

Figure 7:
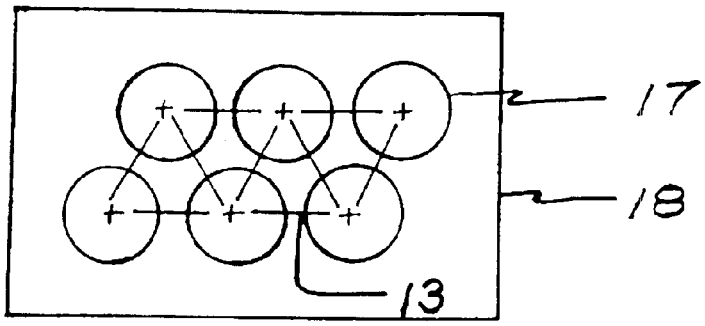
FIGS. 7–9 show a block support member with a plurality of die cut openings spaced and positioned at predetermined positions to support a plurality of reservoir tubes for simultaneous filling with a fill funnel of the type according to FIGS. 1–6.
Figure 8:
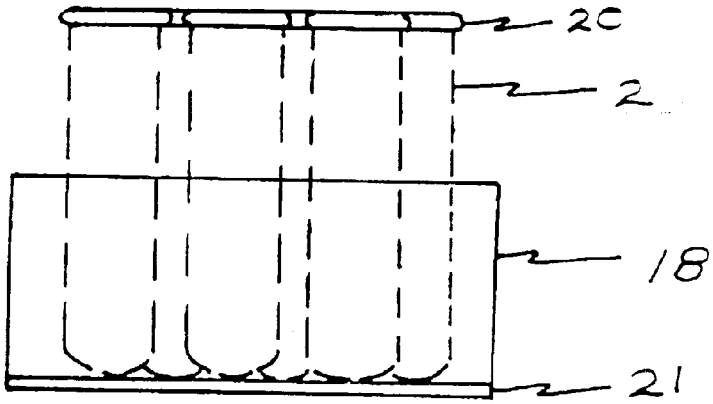
Figure 9:
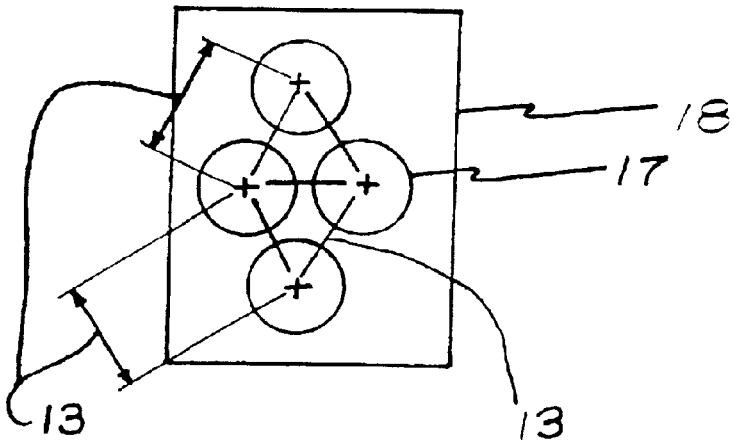

FIGS. 7–9 depict support base 18 as a solid block of semirigid or rigid material with a plurality of openings 17. Support base 18 can be made of a variety of materials but preferably is made of rigid or semirigid foamed plastic that has adequate thickness, width, density, stiffness, and durability to hold reservoir tubes 2 upright when funnel 1 rests on tube rim 20 and despite the moment forces on base 18 as paintballs are quickly dumped into funnel 1. It may be desirable to secure rigid bottom plate 21 to base 18 for additional support and weight.

In some instances, a relatively thick support base 18 may be difficult to stow in a gear bag or represent just one thing too many to carry to the field. A folding support system is shown in FIGS. 10–15.

Figure 10:
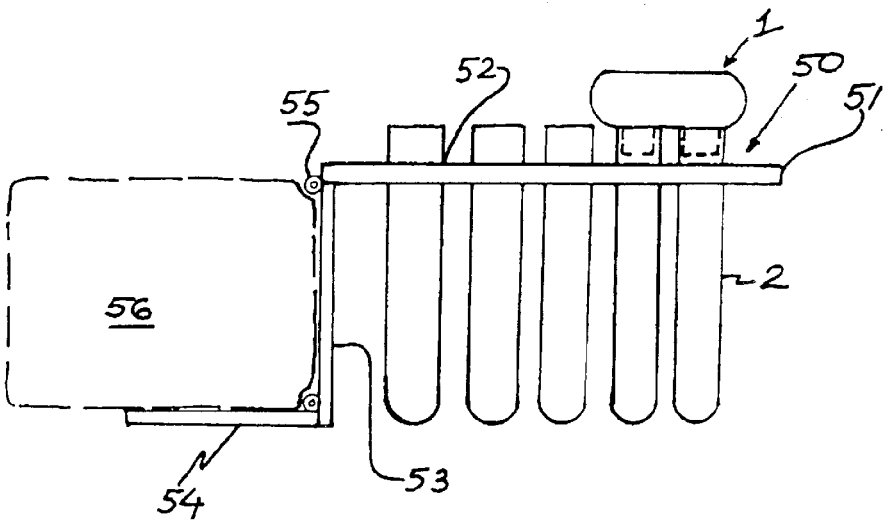
FIGS. 10 and 11 show a hinged, three panel support for a plurality of paintball reservoir tubes.
Figure 11:
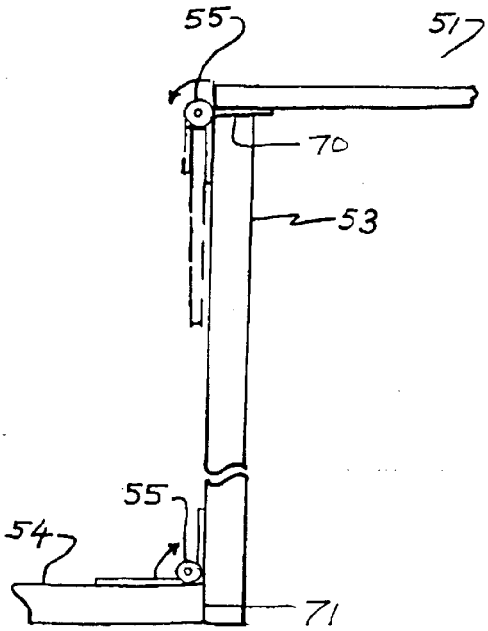

In FIGS. 10 and 11, folding tube support 50 is made with a rigid first panel, such as top panel 51, having a plurality of openings 52 dimensioned to receive and support reservoir tubes 2, in a hinged connection with a rigid second panel such as elevation panel 53 that raises top panel 51 for some distance less than or equal to the height of paintball reservoir tube 2, and a rigid third panel such as bottom panel 54 hinged to elevation panel 53. Hinges 55 are used to secure panels 51, 43, and 54 together in a foldable relationship that will support tubes 2 at a position in the upper half of tube 2, preferably a position that is at or above its center of gravity when fill funnel 1 is rests on the top rim 20 of reservoir tube 2.

Bottom panel 54 slips under a relatively heavy object, such as gear bag 56 or a box of paintballs (not shown), for additional support of top panel 51 and tubes 2 therein. As shown in FIG. 11, hinges 55 are positioned and secured to allow top panel 51 and bottom panel 54 to fold toward elevation panel 53 while providing contact surfaces 70, 71 on the top and bottom side, respectively, of elevation panel 53 when panels 51 and 54 are unfolded for use.

Figure 12:
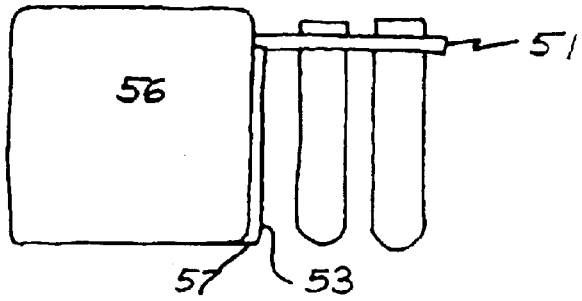
FIG. 12 shows a two piece support in the shape of an "L" secured in an outer pocket of a gear bag.
Figure 13:
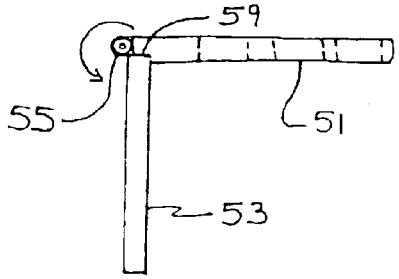
FIG. 13 illustrates the hinge action of the L-shaped support of FIG. 9.

Another version of a folding support system is shown in FIGS. 12 and 13 in which top panel 51 is hinged to elevation panel 53 for supported extension therefrom. Top panel 51 can be notched with notch 59 to accommodate any height difference between hinge 55 and the thickness of top panel 51 so that top panel 51 forms an angle 71 within the range of about 90° to about 110° relative to elevation panel 53. Elevation panel 53 can then be inserted into an outside pocket 57 on gear bag 56. Once refolded, the device is stored within gear bag 56 for convenient transport.

Figure 14:
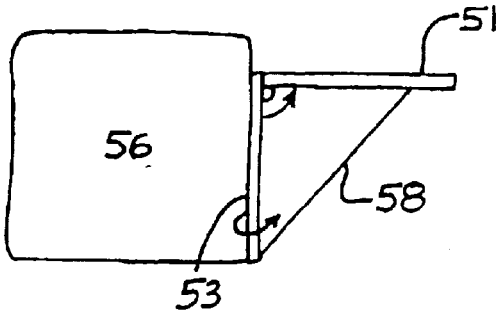
FIG. 14 depicts a reservoir tube support secured to the outside of a gear bag and held in its horizontally extended position with a vertical support that swivels about a hinged connection.

FIG. 14 depicts an embodiment in which elevation panel 53 is built into an outer surface of gear bag 56, and top panel 51 is supported in a horizontally extended position by rotating panel 58. Appropriate grooves, slots, or securing devices can be additionally used to secure rotating panel 58 in an open, supporting position (as shown) or folded against elevation panel 53 and under top panel 51 for transport.

Figure 15:
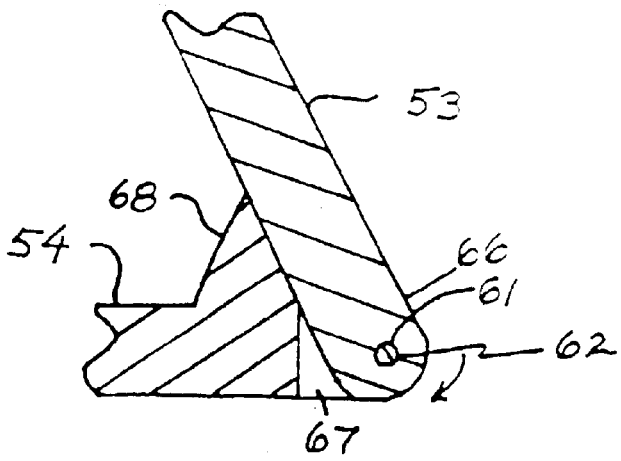
FIG. 15 is a closeup view of a piano hinge joint with a molded stop for a folding tube support.

FIG. 15 illustrates a side view of piano hinge joint that can be used in a folding supporting system of the type shown in FIGS. 10–14. Each of the panels, such as elevation panel 53 and base panel 54, the piano hinge joint is formed from a plurality of alternating projections 66 and recesses 67 on each panel that will fit together and align about a common horizontal axis 61 in which joint pin 62 is inserted and secured by friction, external connector, or threaded connection. Back stop 68 can be formed into bottom panel 54 (as shown) or elevation panel 53 (not shown), or secured thereto as a separate piece (not shown), in order to arrest the rotation of elevation panel 53 around axis 61 and support elevation panel 53. The same joint configuration could be used at the connection between top panel 51 and elevation panel 53.

What is claimed is:

1. A paintball reservoir tube filling kit that comprises:

(a) a paintball fill funnel exhibiting: (i) a central bowl chamber having lateral walls directing paintballs loaded therein without obstruction and directly towards (ii) at least one outlet spout at a bowl-spout junction, said spout having nontapering external walls and dimensions sized to fit within a paintball reservoir tube with an unobstructed discharge opening opposite said bowl-spout junction, and (b) a support rack having at least one opening dimensioned to receive a paintball reservoir tube and support said tube in an upright, vertical posture.

2. A filling kit according to claim 1 wherein said support comprises a block of polymeric foam having (i) sufficient dimensions, density, rigidity to support a filled paintball reservoir tube in an upright position and (ii) a plurality of openings each of which is dimensioned to receive a paintball reservoir tube and support said tube in an upright position.

3. A filling kit according to claim 1 wherein said support rack is able to be folded for storage and comprises a first panel having openings dimensioned to receive at least one paintball reservoir tube and hinged to a rigid second panel that elevates said first panel for a distance.

4. A filling kit according to claim 1 wherein said fill funnel further exhibits: (iii) at least one support shoulder on the outside of said funnel to provide a stable, substantially horizontal plane of support for said funnel when said spout is inserted vertically into a generally cylindrical paintball reservoir tube and said support shoulder rests on an upper rim of said paintball reservoir tube.

* * * * *